US008103027B2

(12) United States Patent
Zhang et al.

(10) Patent No.: US 8,103,027 B2
(45) Date of Patent: Jan. 24, 2012

(54) MICROPHONE WITH REDUCED PARASITIC CAPACITANCE

(75) Inventors: Xin Zhang, Acton, MA (US); Thomas Chen, Cambridge, MA (US); Sushil Bharatan, Arlington, MA (US); Aleksey S. Khenkin, Peterborough, NH (US)

(73) Assignee: Analog Devices, Inc., Norwood, MA (US)

( * ) Notice: Subject to any disclaimer, the term of this patent is extended or adjusted under 35 U.S.C. 154(b) by 483 days.

(21) Appl. No.: 12/411,768

(22) Filed: Mar. 26, 2009

(65) Prior Publication Data

US 2009/0202089 A1 Aug. 13, 2009

Related U.S. Application Data

(63) Continuation-in-part of application No. 12/133,599, filed on Jun. 5, 2008.

(60) Provisional application No. 60/942,315, filed on Jun. 6, 2007.

(51) Int. Cl.
*H04R 25/00* (2006.01)

(52) U.S. Cl. ..... 381/175; 381/191

(58) Field of Classification Search ..... 381/175, 381/174, 190, 191
See application file for complete search history.

(56) References Cited

U.S. PATENT DOCUMENTS 5,870,482 A * 2/1999 Loeppert et al. ..... 381/174
7,346,178 B2 * 3/2008 Zhe et al. ..... 381/174
7,838,323 B2 * 11/2010 Utsumi et al. ..... 257/E21.599
7,839,052 B2 * 11/2010 Wu et al. ..... 381/429

* cited by examiner

*Primary Examiner* — Brian Ensey
(74) *Attorney, Agent, or Firm* — Sunstein Kann Murphy & Timbers LLP

(57) ABSTRACT

A MEMS microphone has an SOI wafer, a backplate formed in a portion of the SOI wafer, and a diaphragm adjacent to and movable relative to the backplate. The backplate has at least one trench that substantially circumscribes a central portion of the backplate.

20 Claims, 13 Drawing Sheets

MICROPHONE WITH REDUCED PARASITIC CAPACITANCE

CROSS-REFERENCE TO RELATED APPLICATIONS

The present application is a continuation-in-part of U.S. patent application Ser. No. 12/133,599 filed Jun. 5, 2008, entitled MICROPHONE WITH ALIGNED APERTURES, which claims priority to U.S. provisional patent application Ser. No. 60/942,315, filed Jun. 6, 2007, entitled MICROPHONE WITH ALIGNED APERTURES, each disclosure of which is incorporated herein by reference in its entirety.

FIELD OF THE INVENTION

The invention generally relates to microphones and, more particularly, the invention relates to MEMS microphones having reduced parasitic capacitance.

BACKGROUND OF THE INVENTION

A conventional MEMS microphone typically has a static substrate/backplate and a flexible diaphragm that together form a variable capacitor. In operation, audio signals cause the movable diaphragm to vibrate, thus varying the distance between the diaphragm and the backplate and producing a changing capacitance. The backplate often is formed from a portion of a silicon-on-insulator (SOI) wafer or formed on or in a bulk silicon wafer. Current MEMS microphone designs using SOI wafers tend to have a very large backplate area compared to the diaphragm, causing the diaphragm-to-backplate parasitic capacitance to be relatively substantial, e.g., on the order of 730 fF. This parasitic capacitance decreases the sensitivity of the microphone and increases its total harmonic distortion (THD), both of which are key performance parameters for MEMS microphone.

SUMMARY OF THE INVENTION

In accordance with one embodiment of the invention, a method of forming a MEMS microphone provides a silicon-on-insulator (SOI) wafer, forms a backplate in a portion of the SOI wafer, and forms a diaphragm adjacent to and movable relative to the backplate. The backplate has at least one trench that substantially circumscribes a central portion of the backplate.

In accordance with another embodiment of the invention, a MEMS microphone includes a SOI wafer, a backplate formed in a portion of the SOI wafer, and a diaphragm adjacent to and movable relative to the backplate. The backplate has at least one trench that substantially circumscribes a central portion of the backplate.

In some embodiments, the diaphragm may have an outer portion and the at least one trench may substantially align with the outer portion of the diaphragm. The diaphragm may have springs formed in an outer portion of the diaphragm. The springs couple the diaphragm to the SOI wafer. The diaphragm may have an area radially inward from the springs and the backplate may have an area radially inward from the at least one trench. The diaphragm area and the backplate area may be substantially the same size. The diameter of the backplate area may be about 12 μm less than or greater than the diameter of the diaphragm area. Tethers may be formed in the backplate. Each tether may be between two adjacent trenches. The tethers couple the backplate area to the SOI wafer. The at least one trench may be filled with a dielectric material.

Additional trenches may be formed in the backplate radially outward from the at least one trench. These additional trenches in the backplate may be aligned near the sides of the diaphragm springs.

In accordance with another embodiment of the invention, a method of forming a MEMS microphone forms a backplate in a portion of a SOI wafer and forms a diaphragm adjacent to and movable relative to the backplate. The method further forms springs in an outer portion of the diaphragm. The springs couple the diaphragm to the SOI wafer. The portion radially inward from the springs defines a diaphragm area. The method further forms at least one trench in the backplate that substantially circumscribes a central portion of the backplate. The at least one trench is substantially aligned with a periphery of the diaphragm area. A MEMS microphone may be formed according to this method.

BRIEF DESCRIPTION OF THE DRAWINGS

The foregoing features of various embodiments of the invention will be more readily understood by reference to the following detailed description, taken with reference to the accompanying drawings, in which.

DESCRIPTION OF ILLUSTRATIVE EMBODIMENTS

In illustrative embodiments, the diaphragm and backplate of a MEMS microphone are configured in such a manner to reduce the parasitic capacitance between these two components. This is accomplished by using at least one trench or gap in the backplate to isolate the active sensing area from the static portion of the backplate. The active backplate sensing area is formed to have about the same size and shape as the movable, inner portion of the diaphragm. This configuration substantially eliminates the parasitic capacitance from the static portion of the backplate, in some embodiments, reducing the current diaphragm-to-backplate parasitic capacitance by as much as seven times, thus increasing the signal sensitivity and reducing the total harmonic distortion (THD) in MEMS microphones. Details of illustrative embodiments are discussed below.

Figure 1:
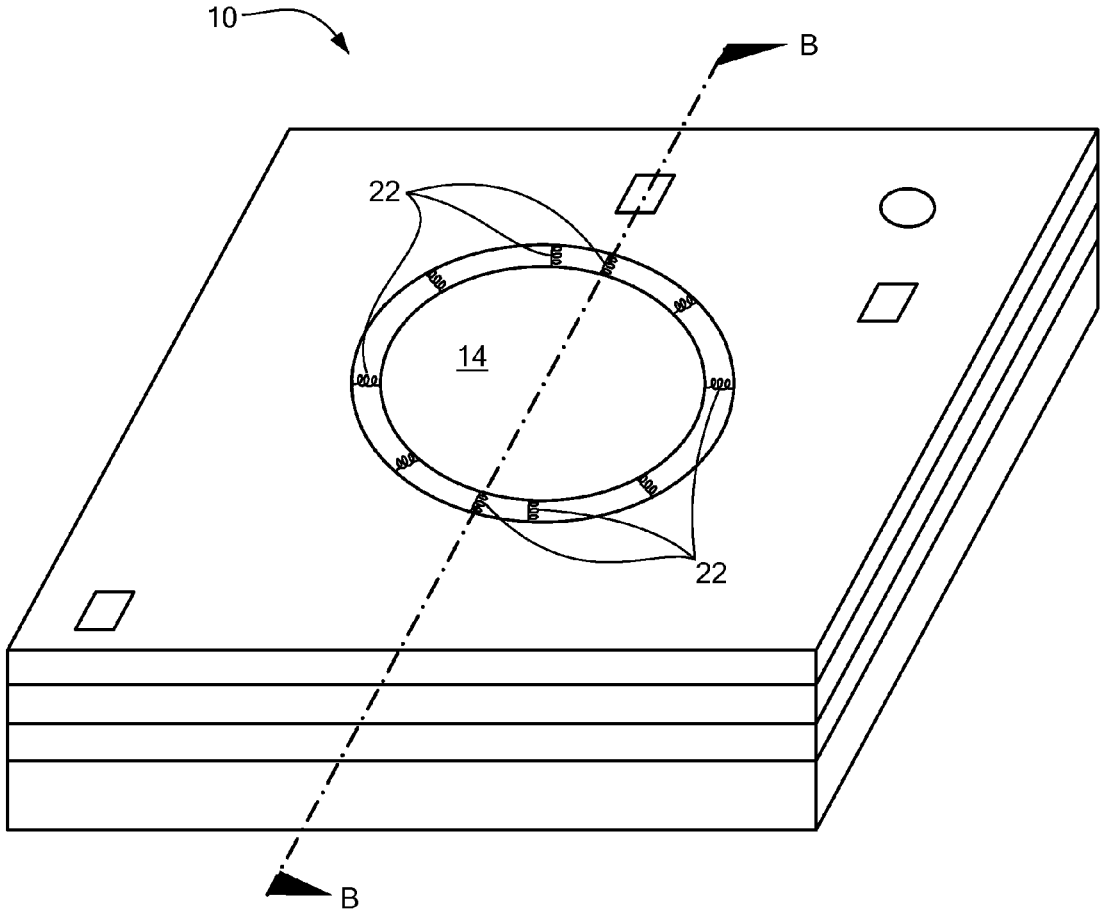
FIG. 1 schematically shows a top, perspective view of a MEMS microphone that may be configured according to illustrative embodiments of the present invention.
Figure 2:
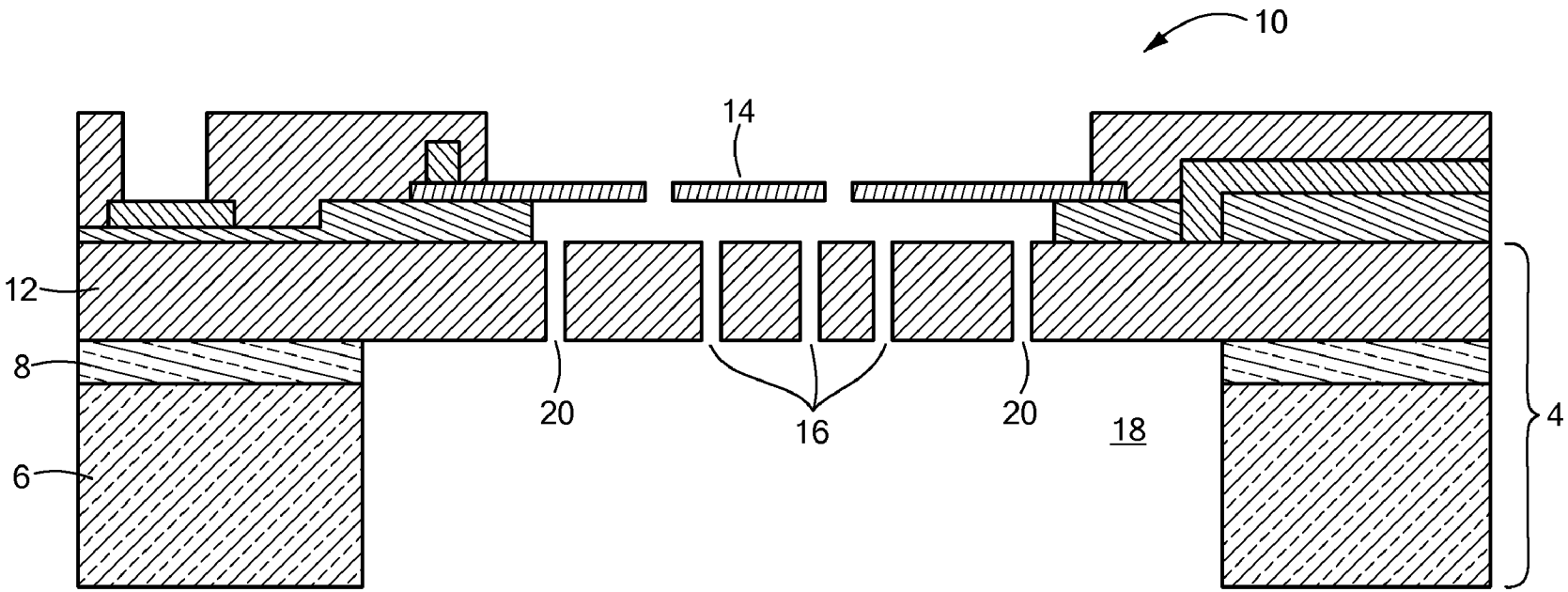
FIG. 2 schematically shows a cross sectional view of the MEMS microphone shown in FIG. 1 across line B-B.

FIG. 1 schematically shows a top, perspective view of an unpackaged microelectromechanical system (MEMS) microphone 10 (also referred to as a "microphone chip") that may be fabricated according to illustrative embodiments of the invention. FIG. 2 schematically shows a cross-sectional view of the microphone 10 of FIG. 1 across line B-B. These figures are discussed simply to detail some exemplary components that may make up a microphone produced in accordance with various embodiments.

As shown in FIG. 2, the microphone chip 10 has a chip base/substrate 4, one portion of which forms a backplate 12. The microphone 10 also includes a flexible diaphragm 14 movable relative to the backplate 12. The backplate 12 and diaphragm 14 form a variable capacitor. In illustrative embodiments, the backplate 12 is formed from single crystal silicon (e.g., a part of a silicon-on-insulator wafer), while the diaphragm 14 is formed from deposited polysilicon. In other embodiments, however, the backplate 12 and diaphragm 14 may be formed from different materials.

In the embodiment shown in FIG. 2, the substrate 4 includes the backplate 12 and other structures, such as the bottom wafer 6 and buried oxide layer 8 of an SOI wafer. A portion of the substrate 4 also forms a backside cavity 18 extending from the bottom of the substrate 4 to the bottom of the backplate 12. To facilitate operation, the backplate 12 has a plurality of through-holes 16 that lead to the backside cavity 18.

It should be noted that various embodiments are sometimes described herein using words of orientation such as "top," "bottom," or "side." These and similar terms are merely employed for convenience and typically refer to the perspective of the drawings. For example, the substrate 4 is below the diaphragm 14 from the perspective of FIG. 2. However, the substrate 4 may be in some other orientation relative to the diaphragm 14 depending on the orientation of the MEMS microphone 10. Thus, in the present discussion, perspective is based on the orientation of the drawings of the MEMS microphone 10.

In operation, audio signals cause the diaphragm 14 to vibrate, thus varying the distance between the diaphragm 14 and the backplate 12 and producing a changing capacitance. Such audio signals may contact the microphone 10 from any direction. For example, the audio signals may travel upward, first through the backplate 12, and then partially through and against the diaphragm 14. In other embodiments, the audio signals may travel in the opposite direction. Conventional on-chip or off-chip circuitry (not shown) converts this changing capacitance into electrical signals that can be further processed. This circuitry may be secured within the same package as the microphone 10, or within another package. It should be noted that discussion of the specific microphone 10 shown in FIGS. 1 and 2 is for illustrative purposes only. Other microphone configurations thus may be used with illustrative embodiments of the invention.

Figure 3:
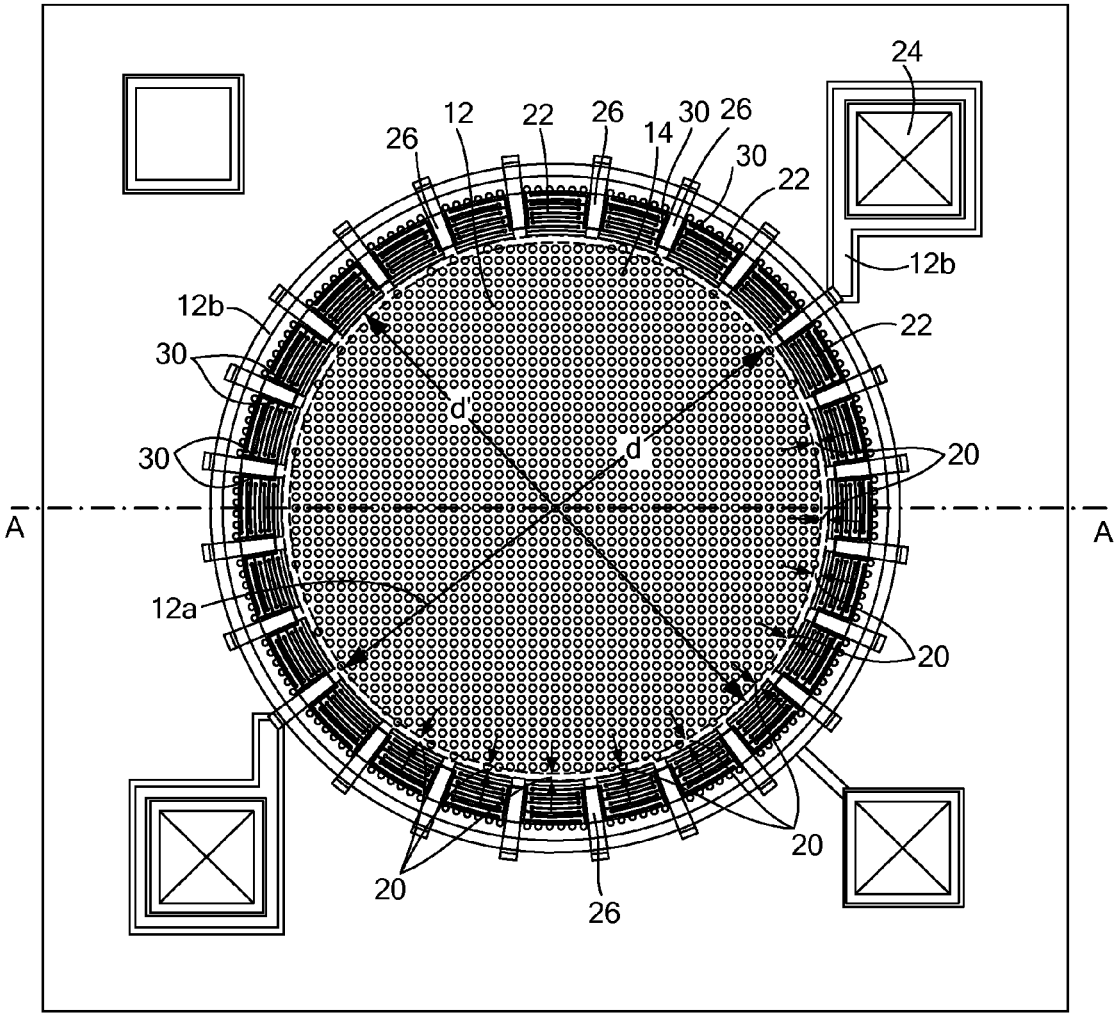
FIG. 3 schematically shows a top view of a MEMS microphone with a backplate having trenches according to illustrative embodiments of the present invention.
Figure 4:
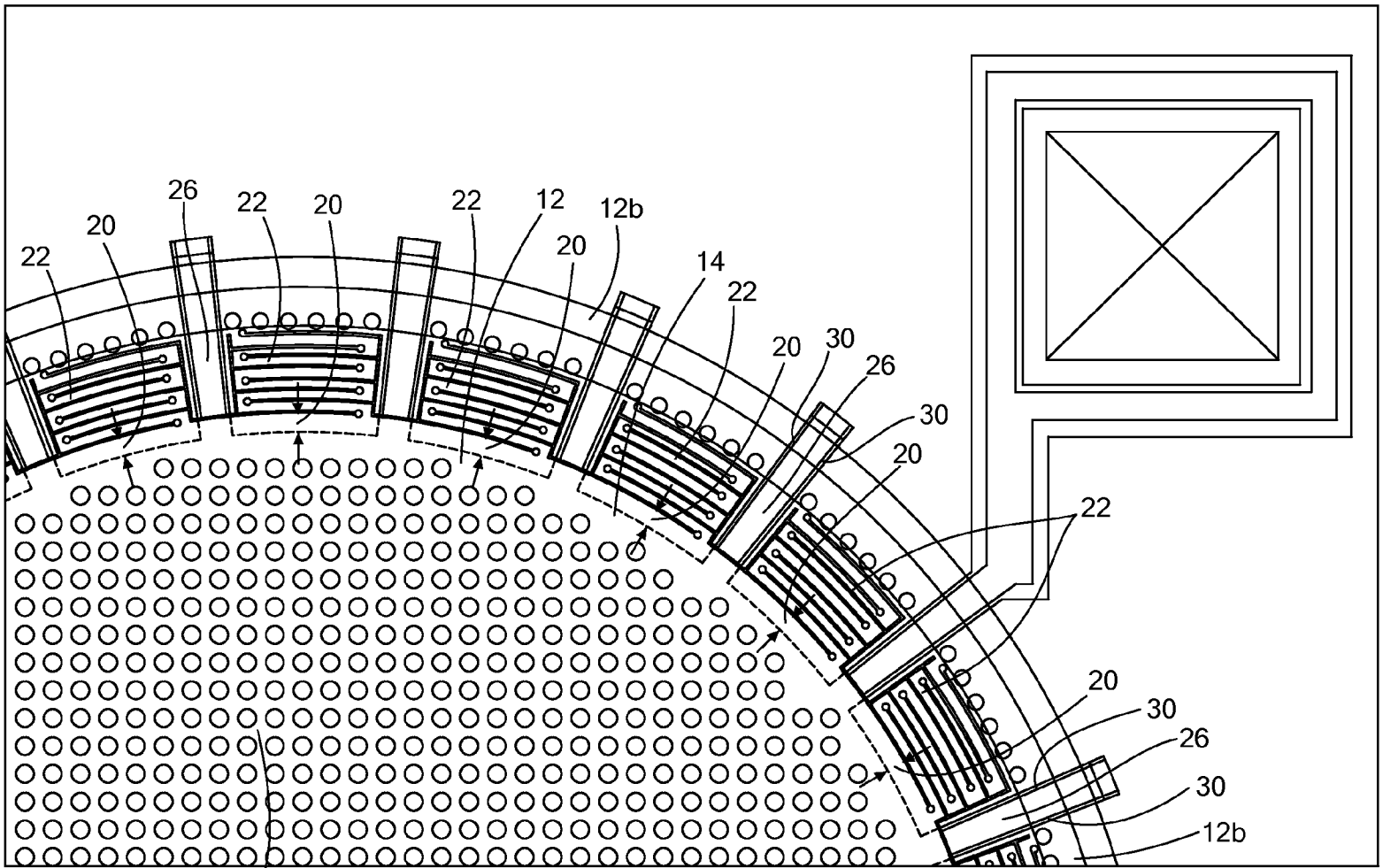
FIG. 4 schematically shows a top view of a portion of the MEMS microphone shown in FIG. 3.
Figure 5:
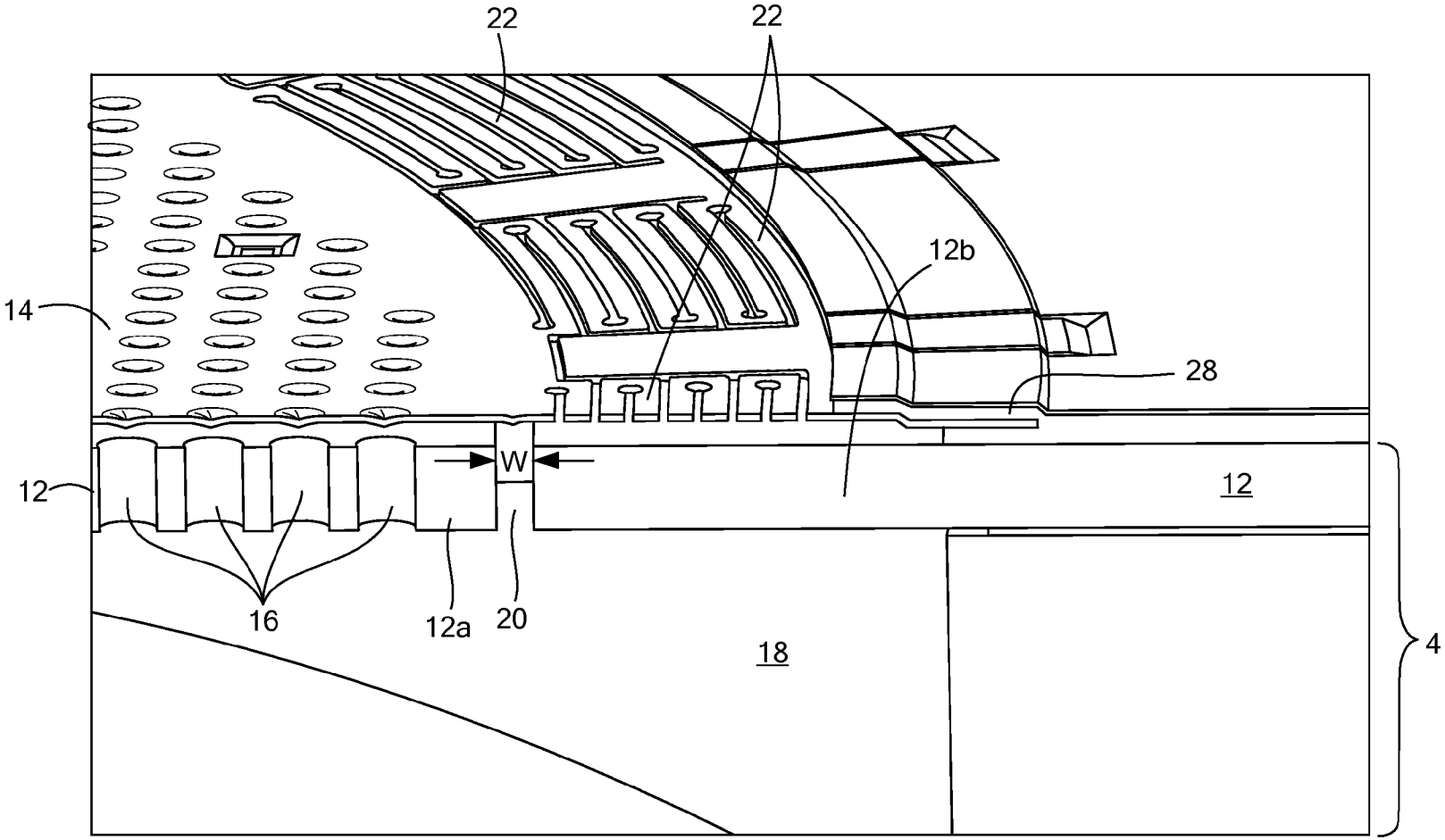
FIG. 5 schematically shows a perspective cross-sectional view of a portion of a MEMS microphone along line A-A of FIG. 3, primarily showing the diaphragm and backplate.
Figure 6:
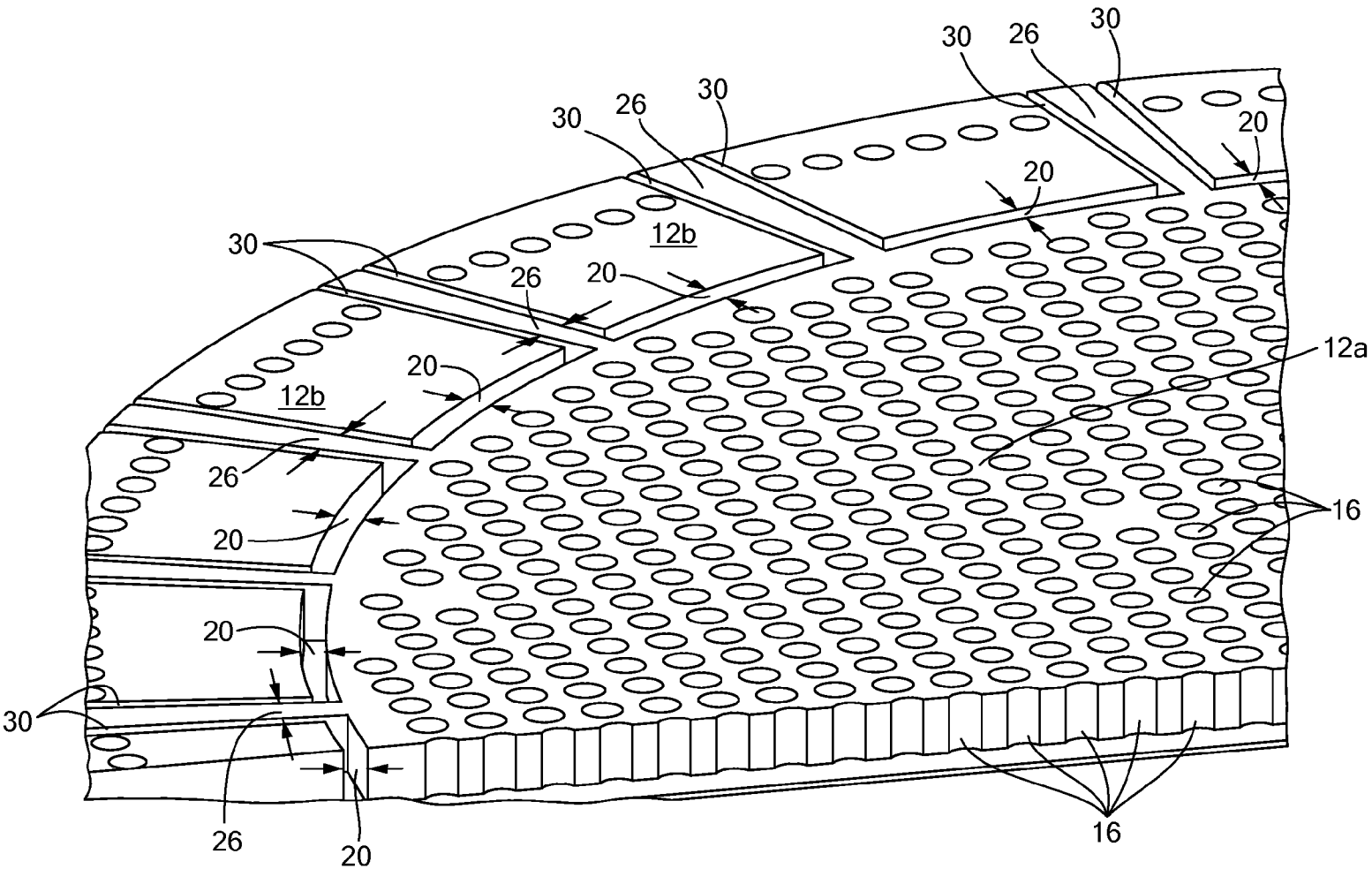
FIG. 6 schematically shows a perspective cross-sectional view of a portion of a MEMS microphone along line A-A of FIG. 3, primarily showing the backplate.
Figure 7:
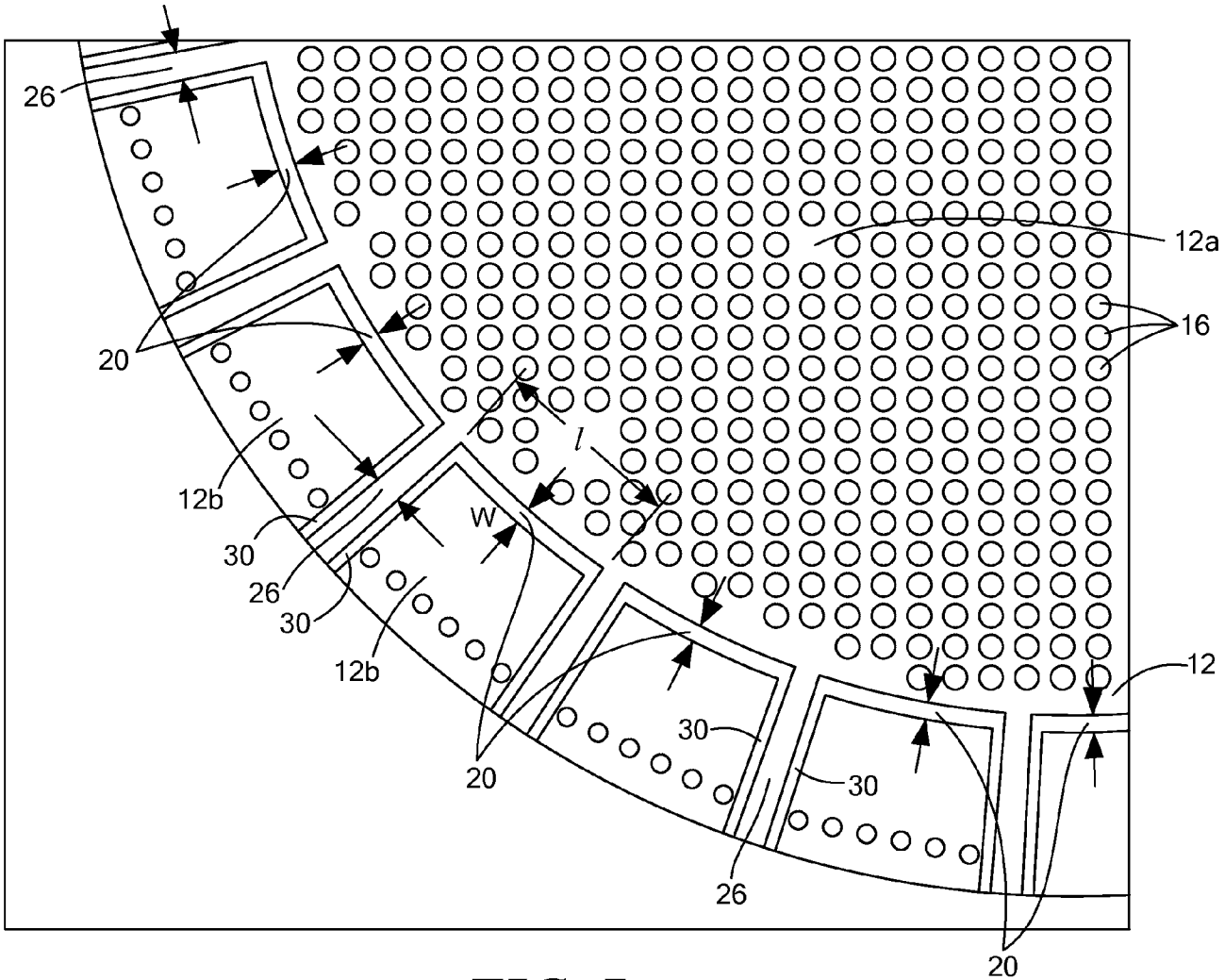
FIG. 7 schematically shows a plan view of a portion of the backplate having trenches according to illustrative embodiments of the present invention.

FIGS. 3-7 schematically show a backplate 12 and diaphragm 14 configuration according to illustrative embodiments of the present invention. Specifically, FIGS. 3 and 4 show a top view of a MEMS microphone 10 with a backplate 12 having trenches or gaps 20 that substantially circumscribe a central portion of the backplate 12. The trenches 20 may be partially or substantially filled with air or other dielectric material, e.g., nitride, oxide, or composite layers such as nitride/polysilicon/nitride layers. Through-holes 16 may be located in the central portion of the backplate 12. Preferably, the trenches 20 in the backplate 12 substantially align with, or are slightly radially inward from, a periphery of the diaphragm 14. FIG. 5 schematically shows a perspective cross-sectional view of a portion of the MEMS microphone 10 along line A-A of FIG. 3, showing the diaphragm 14 and backplate 12 configuration. FIG. 6 schematically shows a perspective cross-sectional view of a portion of a MEMS microphone 10, such as shown in FIG. 5. However, the view is of the underside of the backplate 12 as seen from the backside cavity 18. FIG. 7 schematically shows a plan view of a portion of the backplate 12 shown in FIG. 6.

As shown, the backplate 12 has a central portion with through-holes 16. The backplate 12 also has a series of trenches 20 that substantially circumscribe the through-holes 16 located in the central portion of the backplate 12. The trenches 20 create an active sensing area 12*a* located radially inward from the trenches 20, and effectively isolates this backplate area 12*a* (e.g., diameter d shown in FIG. 3) from the remaining static backplate 12*b* located radially outward from the trenches 20 (e.g., the portion of the backplate 12*b* surrounding the bond pad 24 shown in FIG. 3, among others). Although a series of trenches 20 are shown, embodiments of the present invention may use one or more trenches 20. For example, one trench 20 may circumscribe the central portion of the backplate 12 with one tether (described in more detail below) connecting the central portion of the backplate 12 to the remaining portion of the backplate 12 and the substrate/SOI wafer 4.

The backplate 12 also includes tethers 26 that couple the active backplate area 12*a* to the remaining portion of the backplate 12*b* and the substrate/SOI wafer 4. The tethers 26 are formed between two adjacent trenches 20 and may extend in a radially outward direction from the backplate area 12*a*, although other configurations may be used. Preferably, the number of tethers 26 coincides with the number of diaphragm springs 22 (discussed in more detail below), although more or less tethers 26 may be used. The minimum width of each tether 26 (i.e., the distance between adjacent trenches 20) primarily depends on the number of tethers 26 and the intended operating parameters of the microphone 10. The minimum width of each tether 26 should be wide enough to sustain any shock event, such as an overpressure, the microphone 10 may experience. For example, as shown in FIG. 3, if twenty-four tethers 26 are used, then, in some embodiments, the minimum width of each tether 26 may be around 5 μm or greater in standard operating conditions. If a smaller number of tethers are used, then the minimum width of each tether 26 should be increased.

The backplate trenches 20 may have any width, w (shown in FIG. 7) that allows effective isolation of the central portion or inner active backplate area 12*a* from the remaining portion of the backplate 12*b*. In some embodiments, the trench width may be about 4 μm or greater, although in other embodiments, smaller trench widths may be used. The length, l (shown in FIG. 7) of the trenches 20 may be any distance depending on the number and minimum width of the tethers 26, as well as the diameter of the backplate area 12*a*. The minimum width of the tethers 26 should be small enough so that the electrical resistance through this area is sufficient enough to allow the central portion or active sensing area 12*a* of the backplate 12 to be effectively isolated enough from the remaining static backplate in order to reduce the parasitic capacitance.

As shown in FIGS. 1 and 3-5, the diaphragm 14 has a number of springs 22 formed in an outer portion of the diaphragm 14. The springs 22 movably connect the inner, movable area of the diaphragm 14 to a static/stationary portion 28 of the microphone 10, which includes the substrate/SOI wafer 4. The inner, movable area of the diaphragm 14 is located radially inward from the springs 22 (e.g., diameter d' shown in FIG. 3). The springs 22 suspend the diaphragm 14 generally parallel to and above the backplate 12. As shown more clearly in FIG. 5, the springs 22 may have a serpentine shape. In alternative embodiments, the springs 22 may have another shape.

In order to reduce the parasitic capacitance between the backplate 12 and the diaphragm 14, the backplate area 12*a* is formed to have about the same size and shape as the inner, movable area of the diaphragm 14. For example, a microphone 10 having an inner, movable diaphragm area of about a 500 μm diameter would, preferably, have a backplate area 12*a* diameter of about 500 μm. However, due to topological variations during processing, the trenches 20 are preferably formed slightly radially inward from the springs 22 in the periphery of the inner, movable area of the diaphragm 14, such as shown in FIG. 5. Thus, the trenches 20 should substantially align with the periphery of the diaphragm area. For example, the trenches 20 may be formed about 4 to 6 μm radially inward from the springs 22 in order to ensure that the trench 20 structure does not negatively impact a portion of the spring 22 structure during its fabrication. Thus, using this example, a microphone 10 having an inner, movable diaphragm area of about a 500 μm diameter would have a backplate area 12*a* diameter of about 488-492 μm, or about 8 to 12 μm less than the diaphragm 14 diameter. Alternatively, the trenches 20 may be formed slightly radially outward from the springs 22. Thus, in this example, a microphone 10 having an inner, movable diaphragm area of about a 500 μm diameter would have a backplate area 12*a* diameter of about 508-512 μm, or about 8 to 12 μm greater than the diaphragm 14 diameter. Although the figures all show and discuss a circular diaphragm 14 and backplate 12 configuration, other shapes may also be used, e.g., oval shapes.

As shown in FIGS. 3, 4, 6 and 7, additional trenches 30 may be formed in the backplate 12 along side the tethers 26. The additional trenches 30 may be formed from each edge of a trench 20 in a radially outward direction relative to the center of the backplate 12. Preferably, the additional trenches 30 are formed and then aligned so that one additional trench 30 is on either side of each spring 22 in the diaphragm 14. Thus, when the diaphragm 14 is aligned on top of the backplate 12 (such as shown in FIGS. 3 and 4), one trench 20 is aligned on the inner side of a spring 22, and two additional trenches 30 are aligned on either side of the spring 22. Since the spring 22 and the backplate 12 also form a variable capacitor, this configuration allows the overall parasitic capacitance of the microphone 10 to be further reduced since the spring 22 area of the diaphragm 14 is effectively eliminated when measuring the backplate 12 to diaphragm 14 variable capacitance. Although the spring 22 and backplate 12 capacitor produces less capacitance change than the diaphragm 14 and backplate 12 capacitor due to the partial deflection of the springs 22, it is nevertheless preferable to exclude the capacitance between the spring 22 and backplate 12 from the total sensing capacitance in order to increase the microphone 10 sensitivity.

Figure 8A:
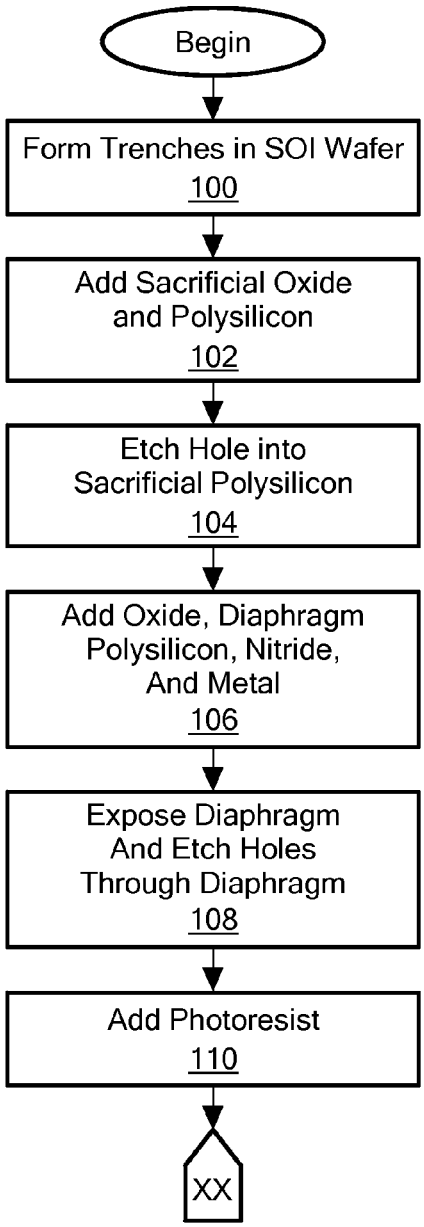
FIGS. 8A and 8B show a process of forming a MEMS microphone, such as shown in FIGS. 1-7, according to illustrative embodiments of the invention.
Figure 8B:
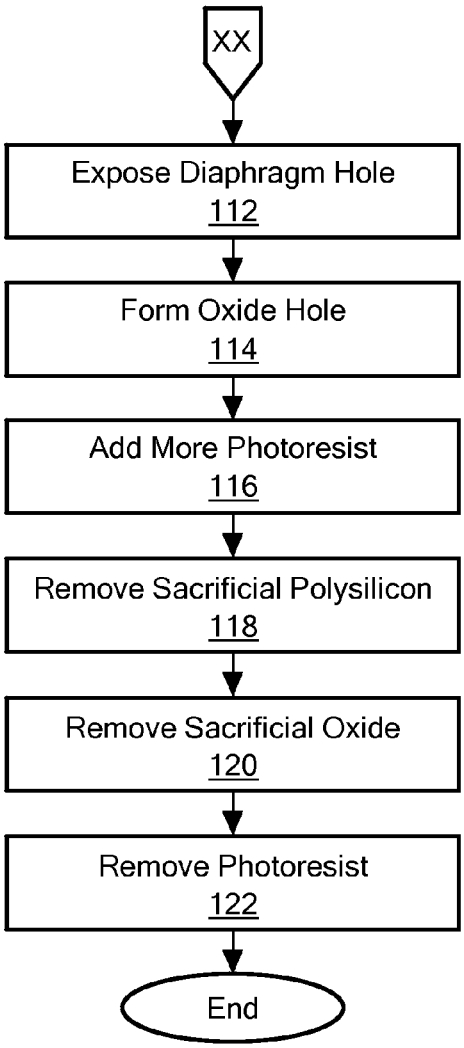

FIGS. 8A and 8B show a process of forming a microphone, such as shown in FIGS. 1-7, in accordance with illustrative embodiments of the invention. The remaining figures (FIGS. 9A-9H) illustrate various steps of this process. Although the following discussion describes various relevant steps of forming a MEMS microphone, it does not describe all the required steps. Other processing steps may also be performed before, during, and/or after the discussed steps. Such steps, if performed, have been omitted for simplicity. The order of the processing steps may also be varied and/or combined. Accordingly, some steps are not described and shown.

Figure 9A:
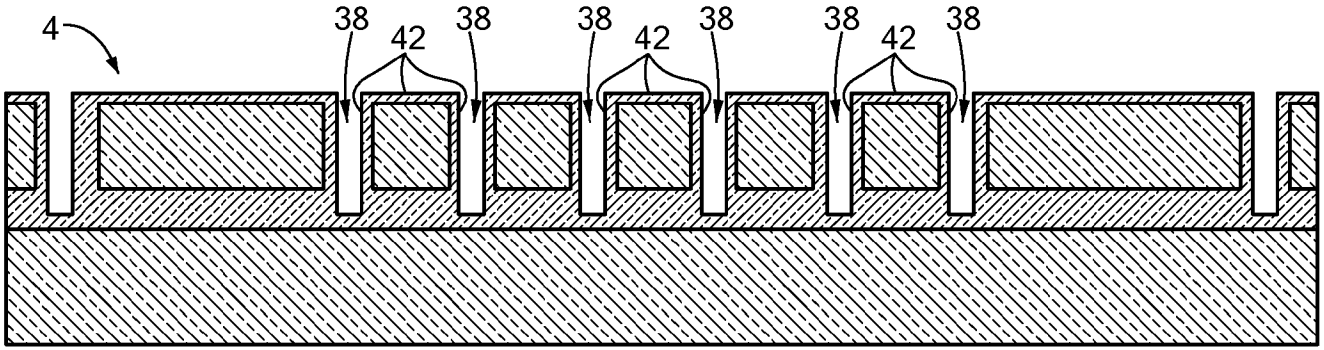
FIGS. 9A-9H schematically show a MEMS microphone, such as shown FIGS. 1-7, during various stages of fabrication using the process of FIGS. 8A and 8B.

The process begins at step 100, which etches trenches 38 in the top layer of a silicon-on-insulator wafer 4. These trenches 38 ultimately form the backplate through-holes 16 and the one or more trenches or gaps 20 in the backplate 12. In step 102, the process adds sacrificial oxide 42 to the walls of the trenches 38 and along at least a portion of the top surface of the top layer of the SOI wafer 4. Among other ways, this oxide 42 may be grown or deposited. FIG. 9A schematically shows the wafer at this point in the process. Step 102 continues by adding sacrificial polysilicon 44 to the oxide lined trenches 38 and top-side oxide 42, such as shown in FIG. 9B.

Figure 9B:
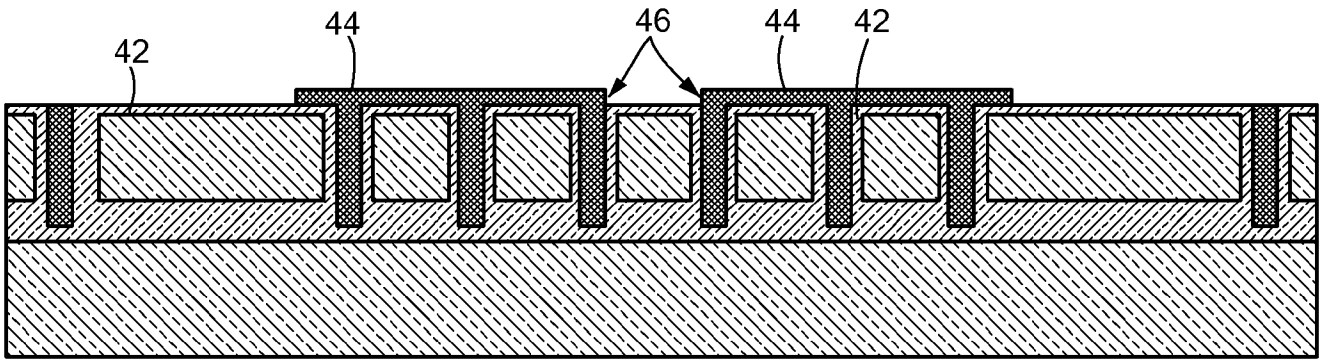
Figure 9C:
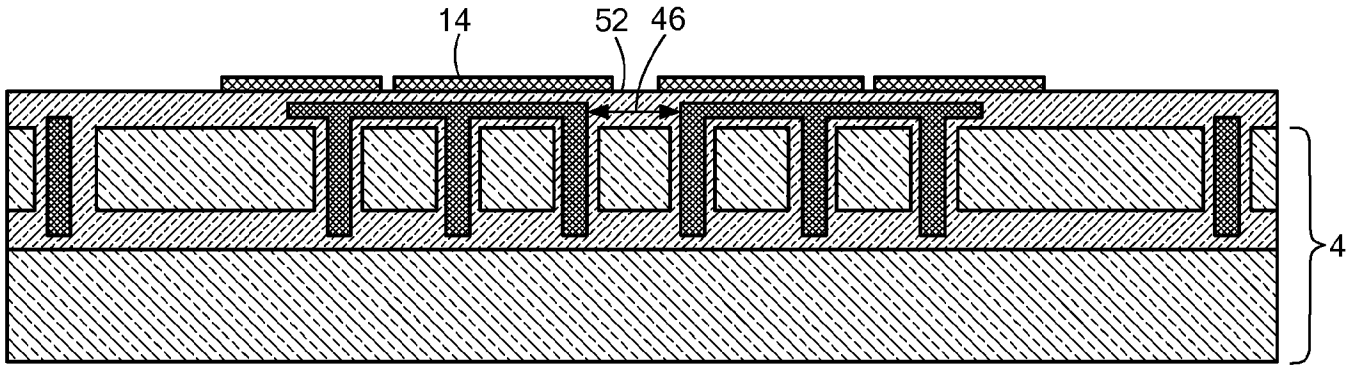

After adding the sacrificial polysilicon 44, the process etches a hole 46 into the sacrificial polysilicon 44 (step 104, see FIG. 9B). The process then continues to step 106, which adds more oxide 42 to substantially encapsulate the sacrificial polysilicon 44. In a manner similar to other steps that add oxide 42, this oxide 42 essentially integrates with other oxides it contacts. Step 106 continues by adding an additional polysilicon layer that ultimately forms the diaphragm 14 (see FIG. 9C). This layer is patterned to substantially align the periphery of the movable, inner diaphragm area with the backplate trenches 20 and the diaphragm springs 22 with the additional trenches 30, in the manner discussed above.

Figure 9D:
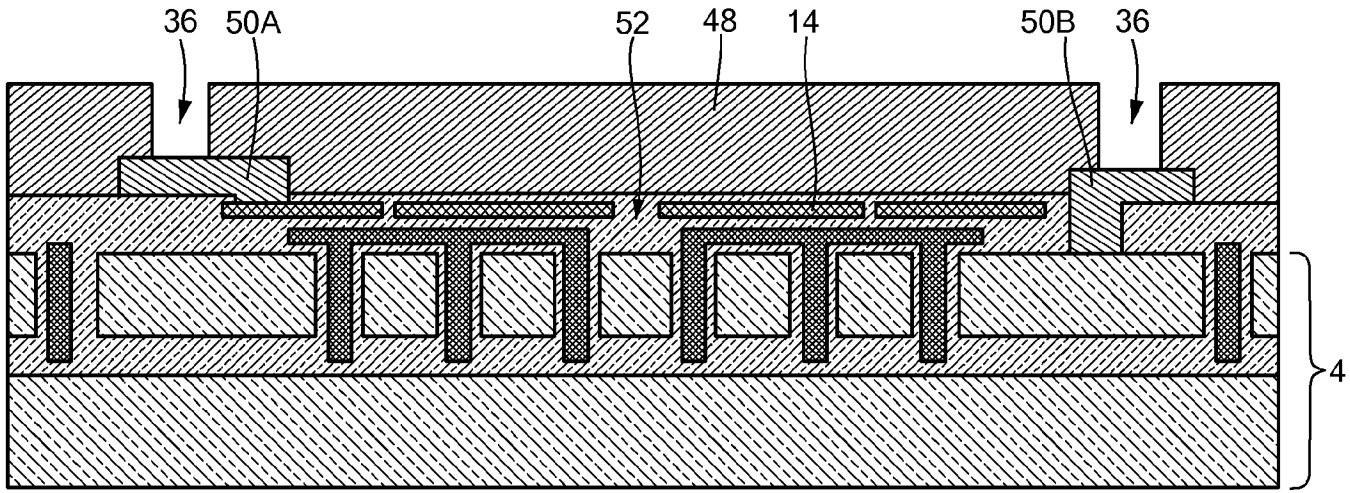

Nitride 48 for passivation and metal for electrical connectivity may also be added (see FIG. 9D). For example, deposited metal may be patterned to form a first electrode 50A for placing electrical charge on the diaphragm 14, another electrode 50B for placing electrical charge on the backplate 12, and contacts 36 for providing additional electrical connections.

Figure 9E:
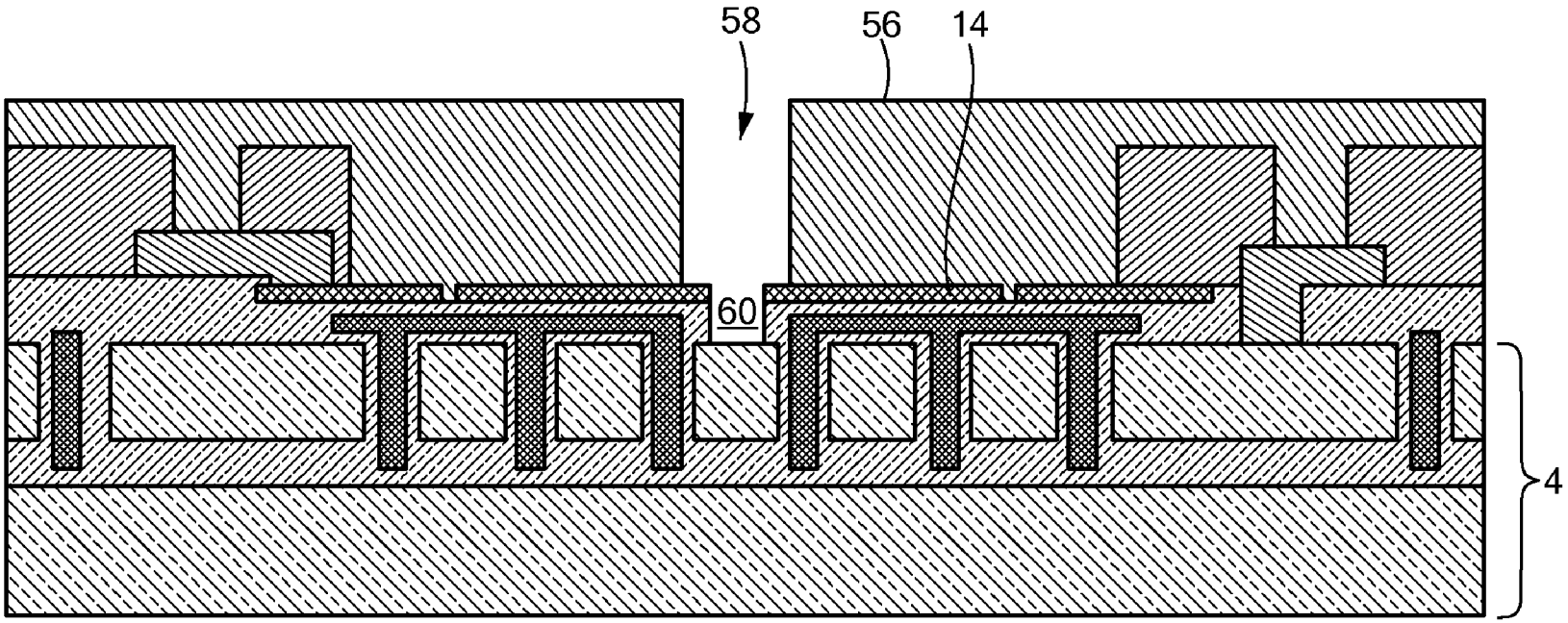

The process then both exposes the diaphragm 14, and etches holes through the diaphragm 14 (step 108). As discussed below in greater detail, one of these holes ("diaphragm hole 52") ultimately assists in forming a pedestal 54 that, for a limited time during this process, supports the diaphragm 14. As shown in FIG. 9E, a photoresist layer 56 then is added, completely covering the diaphragm 14 (step 110). This photoresist layer 56 serves the function of an etch mask.

After adding the photoresist 56, the process exposes the diaphragm hole 52 (step 112). The process forms a hole ("resist hole 58") through the photoresist 56 by exposing that selected portion to light (see FIG. 9E). This resist hole 58 illustratively has a larger inner diameter than that of the diaphragm hole 52.

After forming the resist hole 58, the process forms a hole 60 through the oxide 42 (step 114). In illustrative embodiments, this oxide hole 60 effectively forms an internal channel that extends to the top surface of the SOI wafer 4.

It is expected that the oxide hole 60 initially will have an inner diameter that is substantially equal to the inner diameter of the diaphragm hole 52. A second step, such as an aqueous HF etch, may be used to enlarge the inner diameter of the oxide hole 60 to be greater than the inner diameter of the diaphragm hole 52. This enlarged oxide hole diameter essentially exposes a portion of the bottom side of the diaphragm 14. In other words, at this point in the process, the channel forms an air space between the bottom side of the diaphragm 14 and the top surface of the backplate 12.

Also at this point in the process, the entire photoresist layer 56 may be removed to permit further processing. For example, the process may pattern the diaphragm 14, thus necessitating removal of the existing photoresist layer 56 (i.e., the mask formed by the photoresist layer 56). Other embodiments, however, do not remove this photoresist layer 56 until step 122 (discussed below).

Figure 9F:
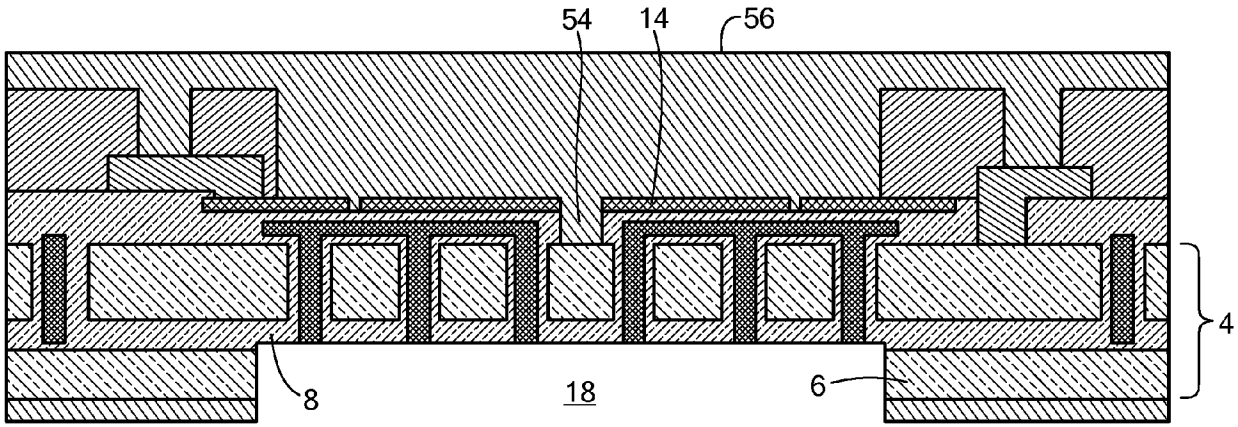
Figure 9G:
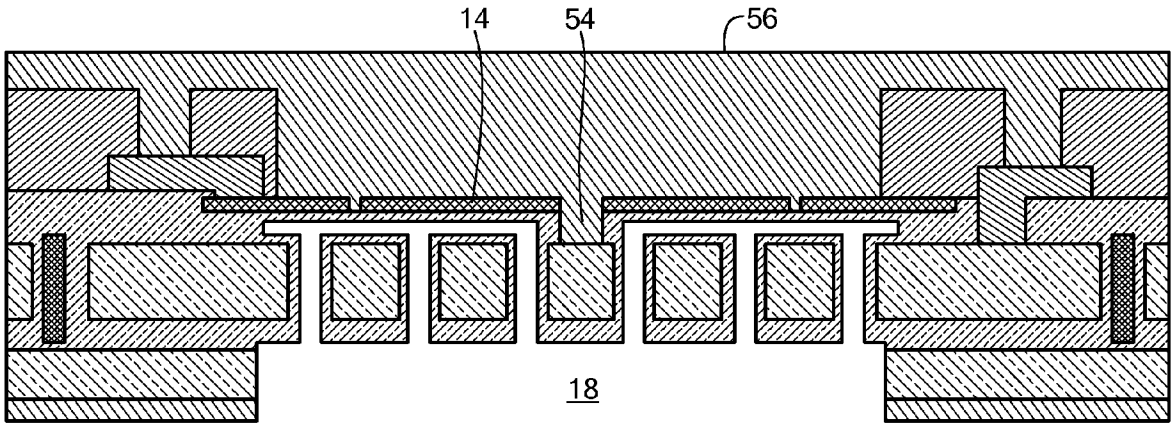

The process then continues to step 116, which adds more photoresist 56, to substantially fill the oxide and diaphragm holes 60, 52 (see FIG. 9F). The photoresist 56 filling the oxide hole 60 contacts the silicon of the top layer of the SOI wafer 4, as well as the underside of the diaphragm 14 around the diaphragm hole 52.

The embodiment that does not remove the original mask thus applies a sufficient amount of photoresist 56 in two steps (i.e., first the mask, then the additional resist to substantially fill the oxide hole 60), while the embodiment that removes the original mask applies a sufficient amount of photoresist 56 in a single step. In both embodiments, as shown in FIG. 9F, the photoresist 56 essentially acts as a single, substantially contiguous material above and below the diaphragm 14. Neither embodiment patterns the photoresist 56 before the sacrificial layer is etched (i.e., removal of the sacrificial oxide 42 and polysilicon 44, discussed below).

In addition, the process may form the backside cavity 18 at this time, such as shown in FIG. 9F. Conventional processes may apply another photoresist mask on the bottom side of the SOI wafer 4 to etch away a portion of the bottom SOI silicon layer 6. This should expose a portion of the oxide layer 8 within the SOI wafer 4. A portion of the exposed oxide layer 8 then is removed to expose the remainder of the sacrificial materials, including the sacrificial polysilicon 44.

At this point, the sacrificial materials may be removed. The process removes the sacrificial polysilicon 44 (step 118, see FIG. 9G) and then the sacrificial oxide 42 (step 120, FIG. 9H). Among other ways, illustrative embodiments remove the polysilicon 44 with a dry etch process (e.g., using xenon difluoride) through the backside cavity 18. In addition, illustrative embodiments remove the oxide 42 with a wet etch process (e.g., by placing the apparatus in an acid bath for a predetermined amount of time). Some embodiments, however, do not remove all of the sacrificial material. For example, such embodiments may not remove portions of the oxide 42. In that case, the oxide 42 may impact capacitance.

Figure 9H:
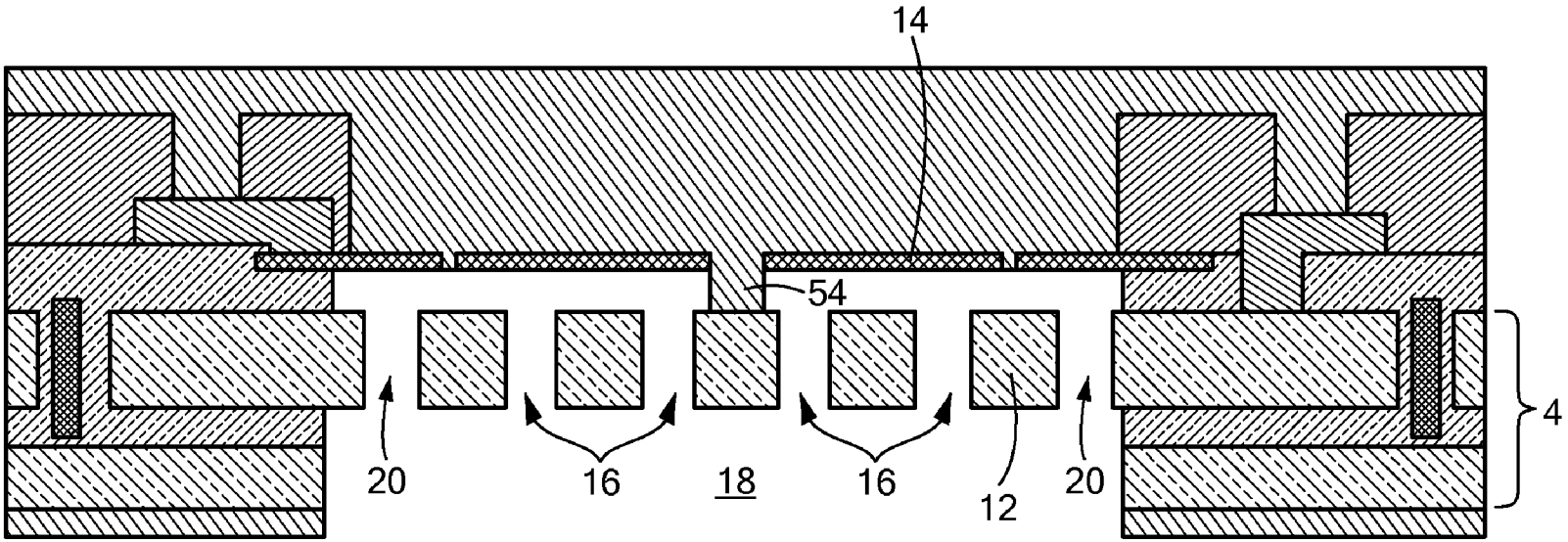

As shown in FIG. 9H, the photoresist 56 between the diaphragm 14 and top SOI layer supports the diaphragm 14. In other words, the photoresist 56 at that location forms a pedestal 54 that supports the diaphragm 22. As known by those skilled in the art, the photoresist 56 is substantially resistant to wet etch processes (e.g., aqueous HF process, such as those discussed above). It nevertheless should be noted that other wet etch resistant materials may be used. Discussion of photoresist 56 thus is illustrative and not intended to limit the scope of all embodiments.

Stated another way, a portion of the photoresist 56 is within the prior noted air space between the diaphragm 14 and the backplate 12; namely, it interrupts or otherwise forms a part of the boundary of the air space. In addition, as shown in the figures, this photoresist 56 extends as a substantially contiguous apparatus through the hole 52 in the diaphragm 14 and on the top surface of the diaphragm 14. It is not patterned before removing at least a portion of the sacrificial layers. No patterning steps are required to effectively fabricate the microphone 10.

To release the diaphragm 14, the process continues to step 122, which removes the photoresist 56/pedestal 54 in a single step, such as shown in FIG. 2. Among other ways, dry etch processes through the backside cavity 18 may be used to accomplish this step. This step illustratively removes substantially all of the photoresist 56—not simply selected portions of the photoresist 56.

It should be noted that a plurality of pedestals 54 may be used to minimize the risk of stiction between the backplate 12 and the diaphragm 14. The number of pedestals used is a function of a number of factors, including the type of wet etch resistant material used, the size and shape of the pedestals 54, and the size, shape, and composition of the diaphragm 14. Discussion of a single pedestal 54 therefore is for illustrative purposes.

The process may then complete fabrication of the microphone 10. Specifically, among other things, the microphone 10 may be tested, packaged, or further processed by conventional micromachining techniques. To improve fabrication efficiency, illustrative embodiments of the invention use batch processing techniques to form the MEMS microphone 10. Specifically, rather than forming only a single microphone, illustrative embodiments simultaneously form a two dimensional array of microphones on a single wafer. Accordingly, discussion of this process with a single MEMS microphone is intended to simplify the discussion only and thus, not intended to limit embodiments to fabricating only a single MEMS microphone 10.

As described herein, embodiments using a backplate 12 having one or more trenches 20 that substantially circumscribe a central portion of the backplate 12 substantially reduce the diaphragm-to-backplate parasitic capacitance by isolating the active sensing area 12*a* from the static portion of the backplate 12*b*. This configuration increases the signal sensitivity and reduces the THD in MEMS microphones.

Although the above discussion discloses various exemplary embodiments of the invention, it should be apparent that those skilled in the art can make various modifications that will achieve some of the advantages of the invention without departing from the true scope of the invention.

What is claimed is:

1. A method of forming a MEMS microphone, the method comprising:

providing a silicon-on-insulator (SOI) wafer;

forming a backplate in a portion of the SOI wafer, the backplate having at least one trench that substantially circumscribes a central portion of the backplate; and forming a diaphragm adjacent to and movable relative to the backplate.

2. The method of claim 1 wherein the diaphragm has an outer portion and the at least one trench substantially aligns with the outer portion of the diaphragm.

3. The method of claim 1 further comprising:

forming springs in an outer portion of the diaphragm, the springs coupling the diaphragm to the SOI wafer, the diaphragm having an area radially inward from the springs and the backplate having an area radially inward from the at least one trench, the diaphragm area and the backplate area having substantially the same size.

4. The method of claim 1 further comprising:

forming springs in an outer portion of the diaphragm, the springs coupling the diaphragm to the SOI wafer, the diaphragm having an area radially inward from the springs and the backplate having an area radially inward from the at least one trench, wherein the diameter of the backplate area is about 12 μm less than or greater than the diameter of the diaphragm area.

5. The method of claim 1 wherein the backplate has an area radially inward from the at least one trench, the method further comprising:

forming a plurality of trenches that substantially circumscribe a central portion of the backplate; and forming tethers in the backplate, each tether between two adjacent trenches, the tethers coupling the backplate area to the SOI wafer.

6. The method of claim 1 wherein the at least one trench is filled with a dielectric material.

7. The method of claim 1 further comprising forming additional trenches in the backplate radially outward from the at least one trench.

8. The method of claim 7 further comprising:

forming springs in an outer portion of the diaphragm, the springs coupling the diaphragm to the SOI wafer, wherein the additional trenches in the backplate are aligned near the sides of the springs.

9. A MEMS microphone comprising:

a silicon-on-insulator (SOI) wafer;

a backplate formed in a portion of the SOI wafer, the backplate having at least one trench that substantially circumscribes a central portion of the backplate; and a diaphragm adjacent to and movable relative to the backplate.

10. The MEMS microphone of claim 9 wherein the diaphragm has an outer portion and the at least one trench substantially aligns with the outer portion of the diaphragm.

11. The MEMS microphone of claim 9 wherein the diaphragm has springs in an outer portion of the diaphragm, the springs coupling the diaphragm to the SOI wafer, the diaphragm having an area radially inward from the springs and the backplate having an area radially inward from the at least one trench, the diaphragm area and the backplate area having substantially the same size.

12. The MEMS microphone of claim 9 wherein the diaphragm has springs in an outer portion of the diaphragm, the springs coupling the diaphragm to the SOI wafer, the diaphragm having an area radially inward from the springs and the backplate having an area radially inward from the at least one trench, wherein the diameter of the backplate area is about 12 μm less than or greater than the diameter of the diaphragm area.

13. The MEMS microphone of claim 9 wherein the backplate has an area radially inward from the at least one trench, the microphone further comprising:

a plurality of trenches that substantially circumscribe a central portion of the backplate; and tethers, each tether between two adjacent trenches, the tethers coupling the backplate area to the SOI wafer.

14. The MEMS microphone of claim 9 wherein the at least one trench is filled with a dielectric material.

15. The MEMS microphone of claim 9 wherein the backplate has additional trenches formed radially outward from the at least one trench.

16. The MEMS microphone of claim 15 wherein the diaphragm has springs in an outer portion of the diaphragm, the springs coupling the diaphragm to the SOI wafer, wherein the additional trenches in the backplate are aligned near the sides of the springs.

17. A method of forming a MEMS microphone, the method comprising:

forming a backplate in a portion of a silicon-on-insulator (SOI) wafer;

forming a diaphragm adjacent to and movable relative to the backplate;

forming springs in an outer portion of the diaphragm, the springs coupling the diaphragm to the SOI wafer, the diaphragm having an area radially inward from the springs; and forming at least one trench in the backplate that substantially circumscribes a central portion of the backplate, the at least one trench substantially aligning with a periphery of the diaphragm area.

18. The method of claim 17 wherein the backplate has an area radially inward from the at least one trench, the method further comprising:

forming a plurality of trenches that substantially circumscribe a central portion of the backplate; and forming tethers in the backplate, each tether between two adjacent trenches, the tethers coupling the backplate area to the SOI wafer.

19. The method of claim 17 wherein the at least one trench is filled with a dielectric material.

20. A MEMS microphone formed according to the process of claim 17.

* * * * *